US005568160A

United States Patent [19]

Collins

[11] Patent Number: 5,568,160

[45] Date of Patent: Oct. 22, 1996

[54] PLANAR HORN ARRAY MICROWAVE ANTENNA

[76] Inventor: John L. F. C. Collins, 3 Cupar Road, Largoward, Leven, Fife KY9 1HX, United Kingdom

[21] Appl. No.: 388,161

[22] Filed: Feb. 10, 1995

Related U.S. Application Data

[63] Continuation of Ser. No. 965,383, filed as PCT/GB91/00966, Jun. 14, 1991, published as WO91/20109, Dec. 26, 1991, abandoned.

[30] Foreign Application Priority Data

| | | | |
|---|---|---|---|
| Jun. 14, 1990 | [GB] | United Kingdom | 9013337 |
| Jun. 15, 1990 | [GB] | United Kingdom | 9013366 |
| Jan. 8, 1991 | [GB] | United Kingdom | 9100322 |

[51] Int. Cl.[6] ..... H01Q 13/00; H01Q 13/02

[52] U.S. Cl. ..... 343/778; 343/786; 343/776

[58] Field of Search ..... 343/778, 772, 343/776, 780, 786; H01Q 13/00, 13/02

[56] References Cited

U.S. PATENT DOCUMENTS

| | | | |
|---|---|---|---|
| 4,614,947 | 9/1986 | Rammos | 343/786 |
| 4,783,663 | 11/1988 | Rammos et al. | 343/778 |
| 4,878,060 | 10/1989 | Barbier et al. | 343/778 |
| 4,959,658 | 9/1990 | Collins | 343/778 |
| 5,243,357 | 9/1993 | Koike et al. | 343/778 |

FOREIGN PATENT DOCUMENTS

| | | |
|---|---|---|
| 0205212 | 12/1986 | European Pat. Off. . |
| 0213646 | 3/1987 | European Pat. Off. . |
| 2092827 | 8/1981 | United Kingdom . |
| 8909501 | 10/1989 | WIPO . |

OTHER PUBLICATIONS

Abstract from Patent Abstracts of Japan, vol. 12, No. 379 (E-667) (3226), Oct. 11, 1988.

*Primary Examiner*—Hoanganh Le
*Attorney, Agent, or Firm*—Ratner & Prestia

[57] ABSTRACT

Planar microwave antennas are described of the type formed from a plurality of moulded planar layers. A first layer defines horn elements and two underlying layers define waveguide channels communicating with the horn elements. The waveguide channels are formed at the interface between layers by aligned channels in the abutting surfaces. The surfaces of at least the horns and waveguide channels are metallised, and the layers may be secured together by rib welding.

6 Claims, 11 Drawing Sheets

PLANAR HORN ARRAY MICROWAVE ANTENNA

This application is a continuation of U.S. patent application Ser. No. 07/965,383, filed as PCT/GB91/00966, Jun. 14, 1991, published as WO91/20109, Dec. 26, 1991, now abandoned.

FIELD OF THE INVENTION

This invention relates to antennas, particularly (but not exclusively) planar antennas for receiving microwave signals such as direct broadcasting by satellite (DBS) signals.

BACKGROUND OF THE INVENTION

In published International Patent Application WO 89/09501 (PCT/GB89/00330) there is shown a planar antenna comprising two or more moulded planar members. A first planar member is shaped to form an array of horns, each of which is coupled into a waveguide system in a second planar member. In FIG. 7 of WO/89/09501, for example, the waveguide system comprises a network of open-topped channels 111 in planar member 11. The member 11 is formed by resin moulding and metallising. In order to convert the open-topped channels 111 into closed waveguides, a metal shim 12 is sandwiched between the planar member 10 and 11, the shim 12 being slotted at 120 to form coupling slots between the horns and the waveguide system.

This type of construction gives excellent antenna properties, but is not optimised for high volume, low cost production. There is a considerable amount of assembly work, and there can be problems in achieving dimensional accuracy and a good mechanical bond in sandwiching the parts together.

An object of the present invention is to provide an antenna which overcomes or mitigates these problems.

After moulding the planar members it is necessary to (a) form a metallised coating on the surfaces of at least the horn cavities and the waveguide channels and (b) secure the plate-like elements together face-to-face; these steps can potentially be carried out in any order. These operations must meet a number of requirements: the horn cavities and waveguide channels must be located relative to each other to a high degree of accuracy, the metallisation must be free from gaps and breaks to prevent loss of microwave energy by leakage, and the assembly must be mechanically strong and free from the risk of long-term deterioration caused for example by reaction between incompatible materials. At the same time, it is desired to achieve low cost, high volume production.

SUMMARY OF THE INVENTION

The present invention provides a microwave antenna comprising first, second and third planar members, a topmost surface of the first planar member being shaped to form an array of horn elements, a bottommost planar surface of said first member adjoining a topmost surface of said second member and a first network of waveguide channels being formed at the interface between said first and said second members, a bottommost planar surface of said second member adjoining a topmost planar surface of said third member, a second network of waveguide channels being formed at the interface between said second and third members, said first waveguide network being formed by complementary sets of grooves formed in said bottommost surface of said first member and said topmost surface of said second member, and said second waveguide network being formed by complementary sets of grooves formed in said bottommost surface of said second member and said topmost surface of said third member.

The members could be metallised and then secured together in abutment. Preferably, however, the members are first secured together and the surfaces remaining uncovered are then metallised.

In a particularly preferred form of the invention, the first and second members are secured together by rib welding, as more fully described hereinbelow.

In a particularly preferred form of the invention, one face of each of said opposed planar faces is formed to provide channel means adjacent each rib, the channel means preferably comprising identical channels on either side of the rib.

Preferably, the rib welding is effected by hot plate rib welding.

The metallisation is preferably effected by immersing the unitary assembly in a bath for electroless deposition of copper. Preferably, the copper is plated to a thickness of 4 microns.

A further disadvantage of planar antennas formed from a plurality of layers is the leakage of microwave energy from the assembly, particularly at the interfaces between layers. Such leakage can be sealed effectively by simple mechanical means, but only at the expense of increased manufacturing costs.

It is a further object of the invention to obviate or mitigate this disadvantage and to provide an antenna assembly wherein inter-layer energy leakage is reduced by structural means not involving additional manufacturing steps.

For a planar microwave antenna to receive signals, it must be aligned in elevation and azimuth with the signal source. When the antenna is to be mounted on an exterior wall of a building to receive signals from a satellite, the required orientation of the antenna relative to the plane of the wall will depend upon the location of the building within the footprint of the satellite and upon the orientation of the building itself. For aesthetic reasons, it is preferable that the planar antenna should be mounted parallel to the plane of its supporting wall. However, the need to align the receiving axis of the antenna with the satellite means that this is rarely possible. For an antenna receiving DBS signals in Europe, the required elevation might vary with latitude between 15° and 45°. With conventional antennas, where the receiving axis is normal to the plane of the horn array, the antenna must be mounted at a corresponding vertical angle to the wall. Similarly, the antenna must be mounted at a horizontal angle depending upon the orientation of the wall and the azimuth of the satellite.

It is still a further object of the present invention to provide an antenna which can be aligned and mounted such that the horizontal and/or vertical angles at which it is disposed relative to the supporting wall is reduced in comparison with conventional antennas.

Preferably, said complementary grooves are of substantially equal depth.

Preferably also, said-first grooves communicate with said horn elements via slots formed in said first member.

DESCRIPTION OF PREFERRED EMBODIMENTS

Embodiments of the invention will now be described, by way of example only, with reference to the drawings, in which.

Figure 3:
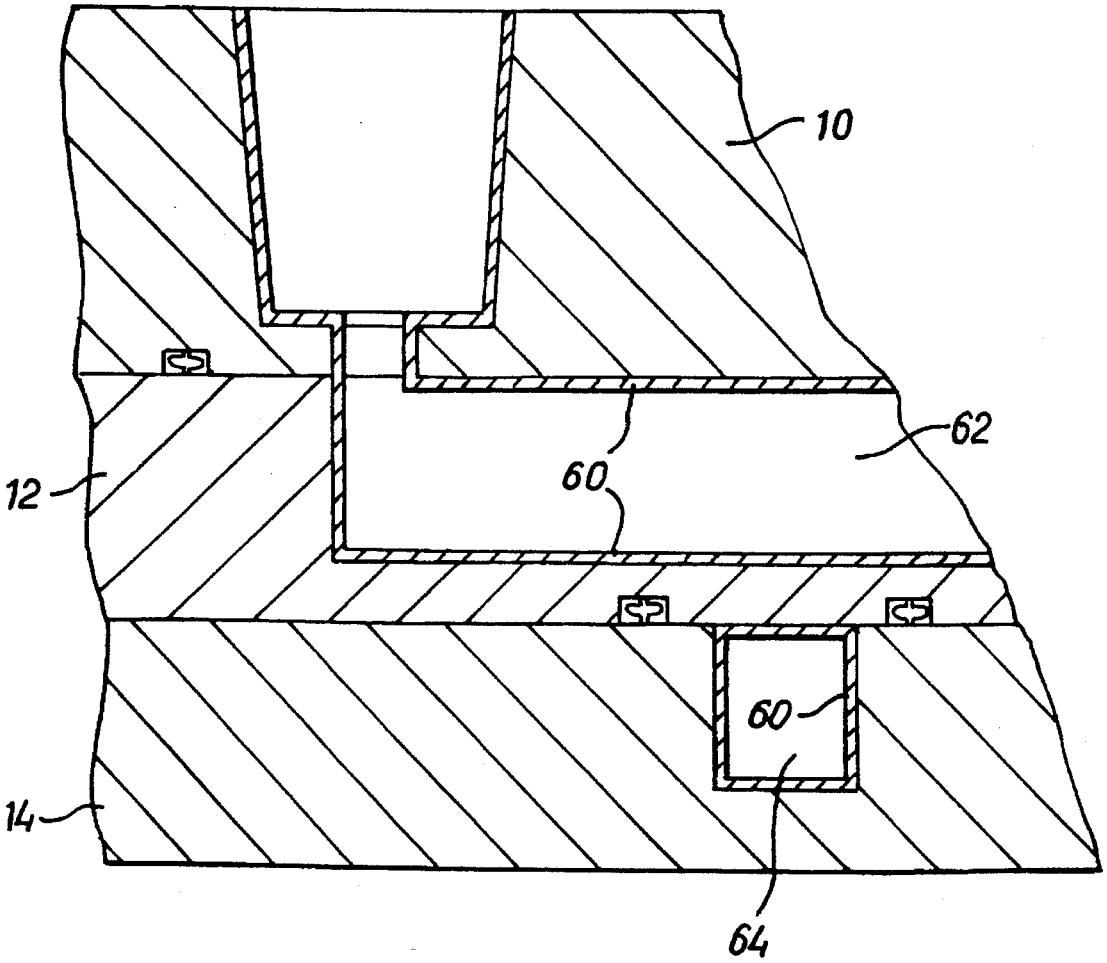
FIG. 3 is a cross-section, to an enlarged scale, of part of the antenna.
Figure 3A:
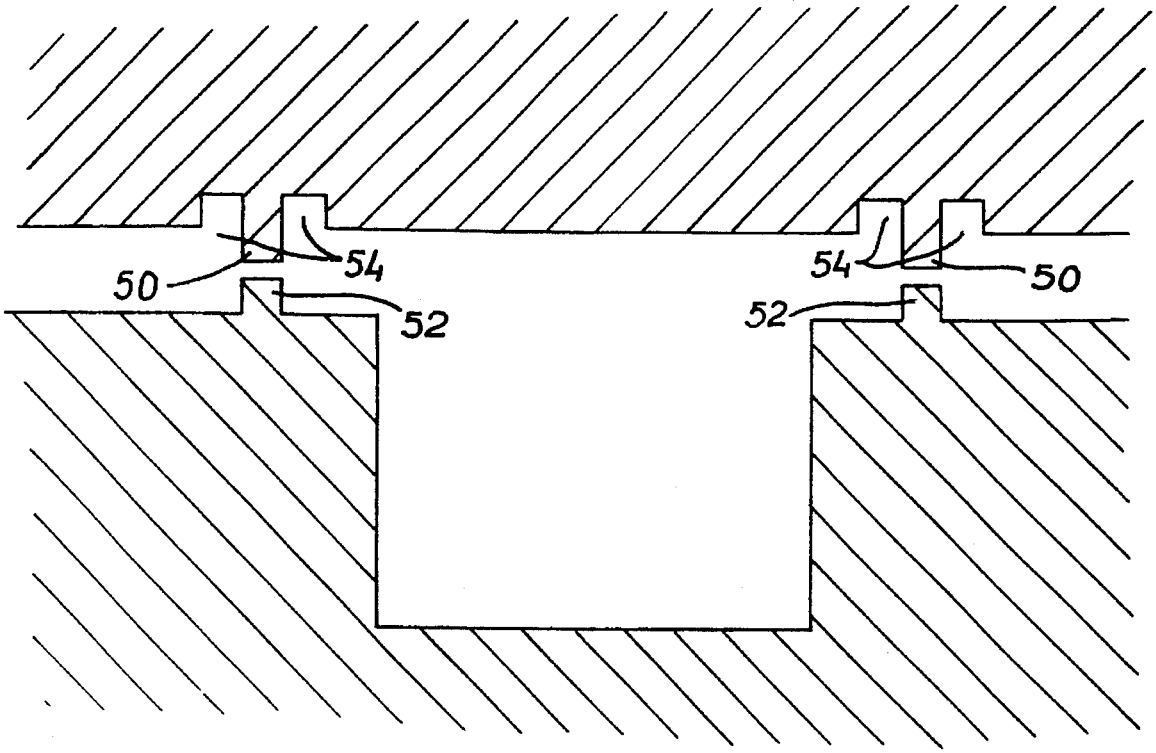
Figure 3B:
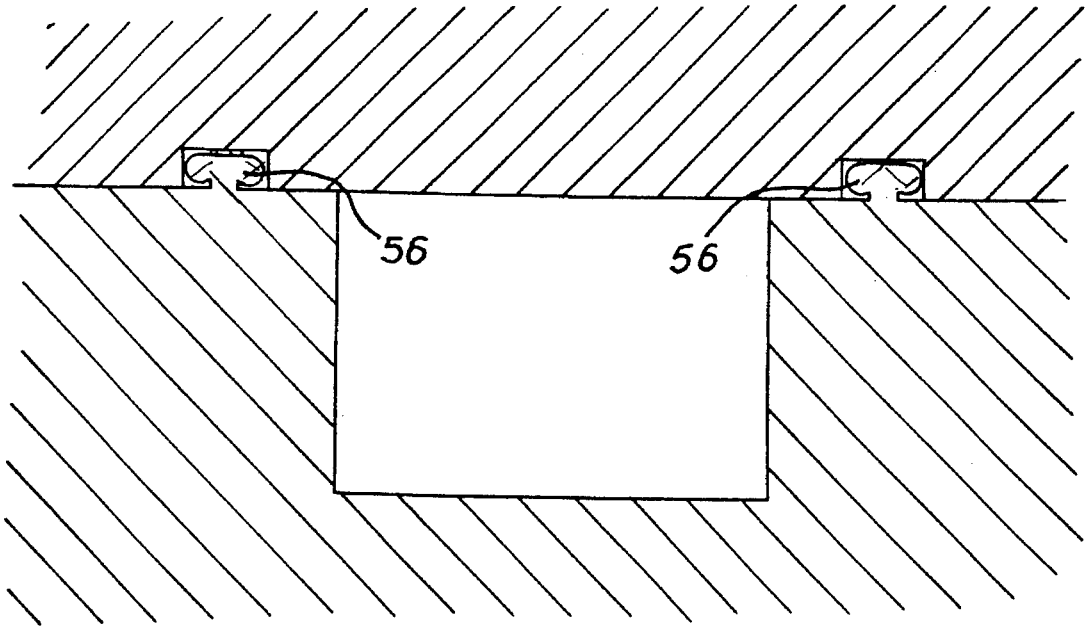
Figure 4:
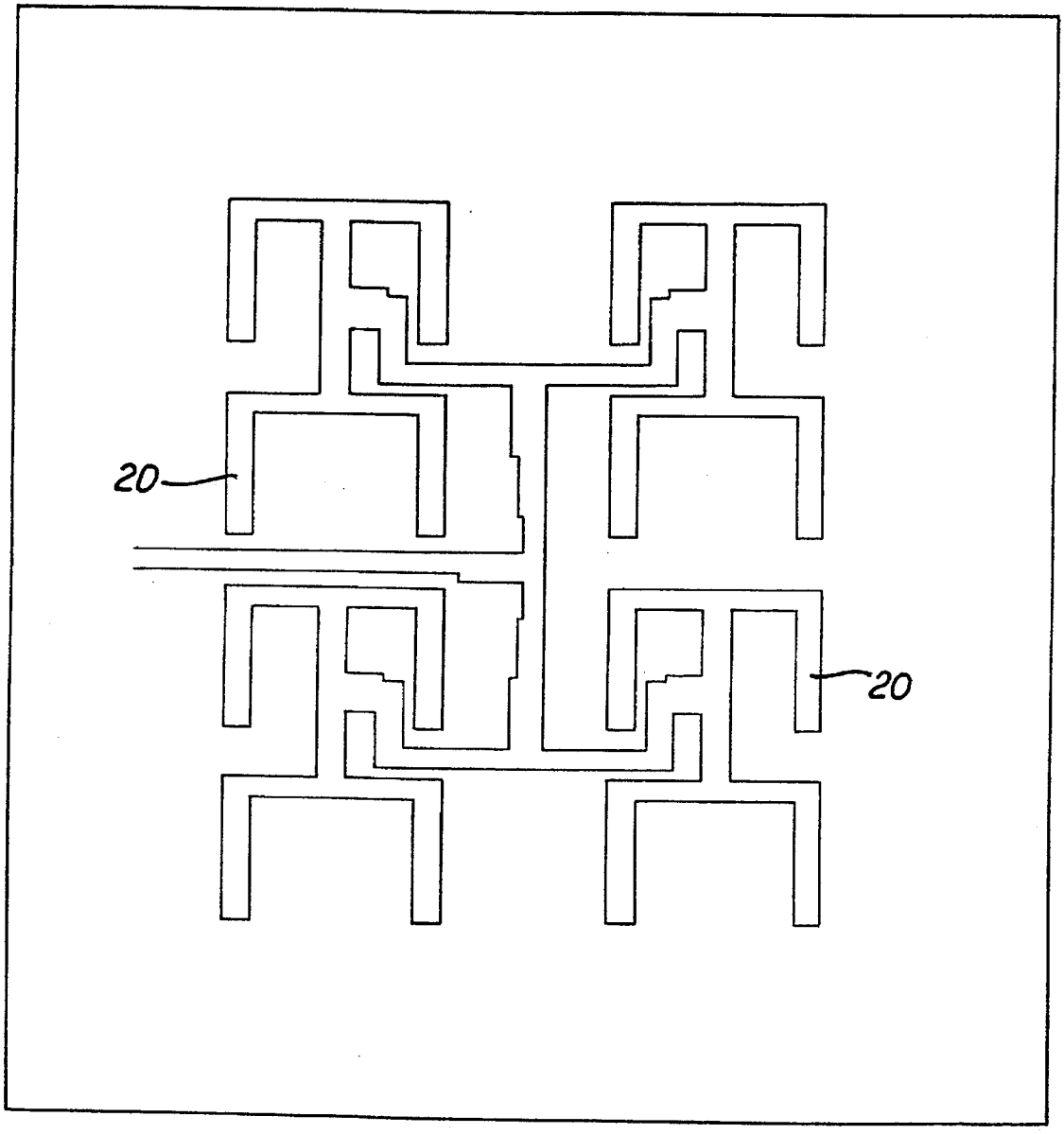
Figure 5:
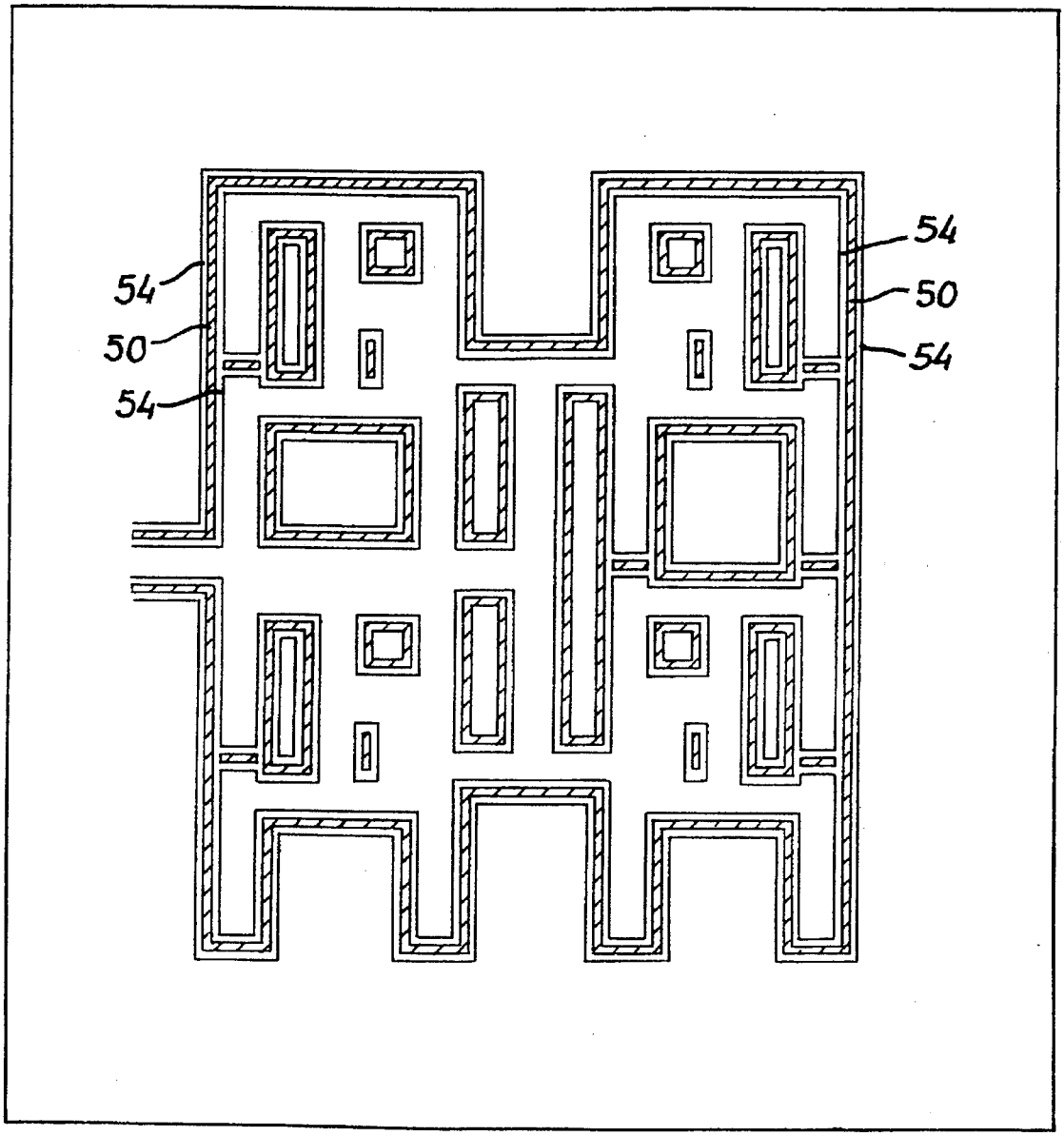
Figure 6:
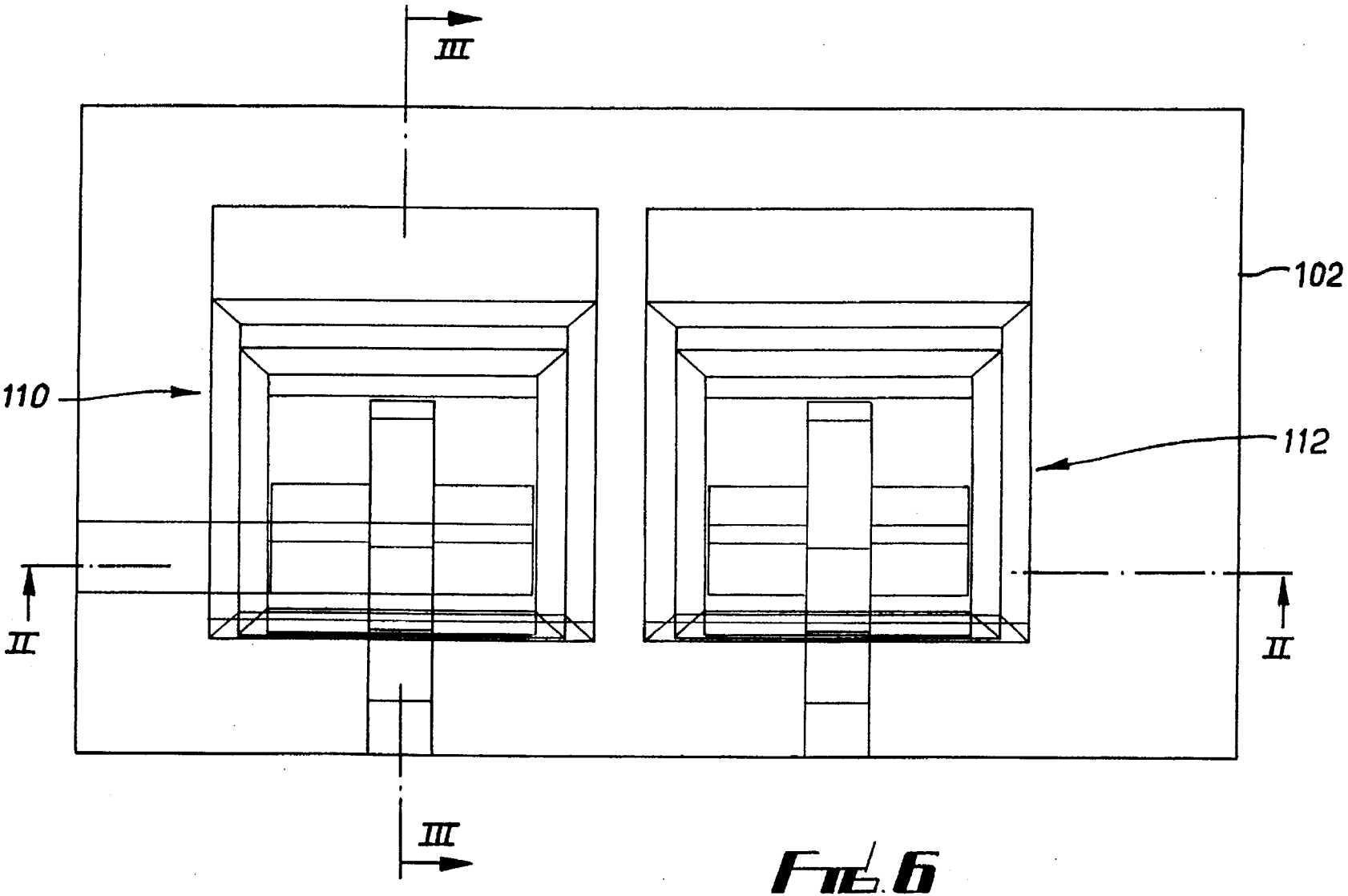
Figure 7:
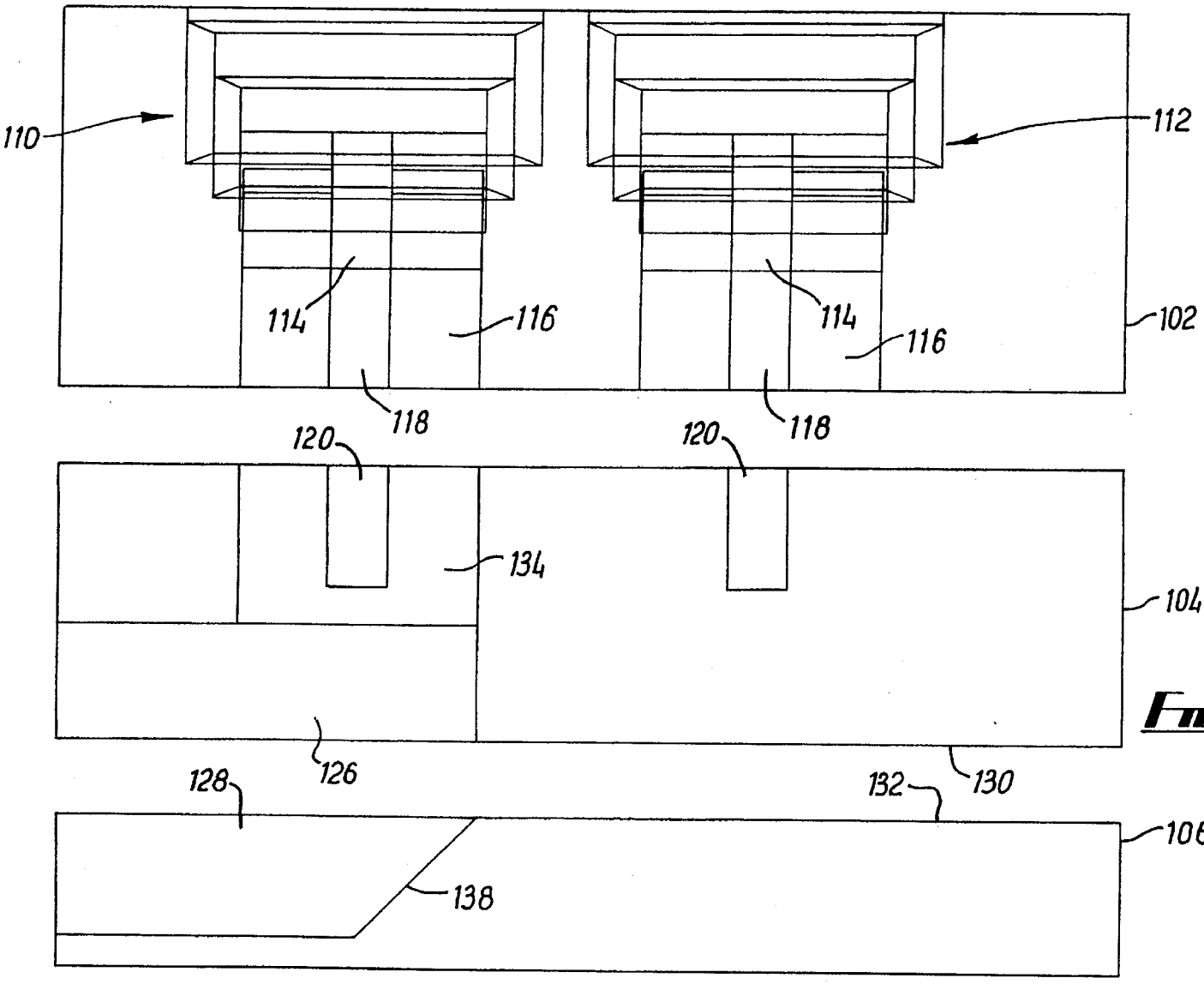
Figure 8:
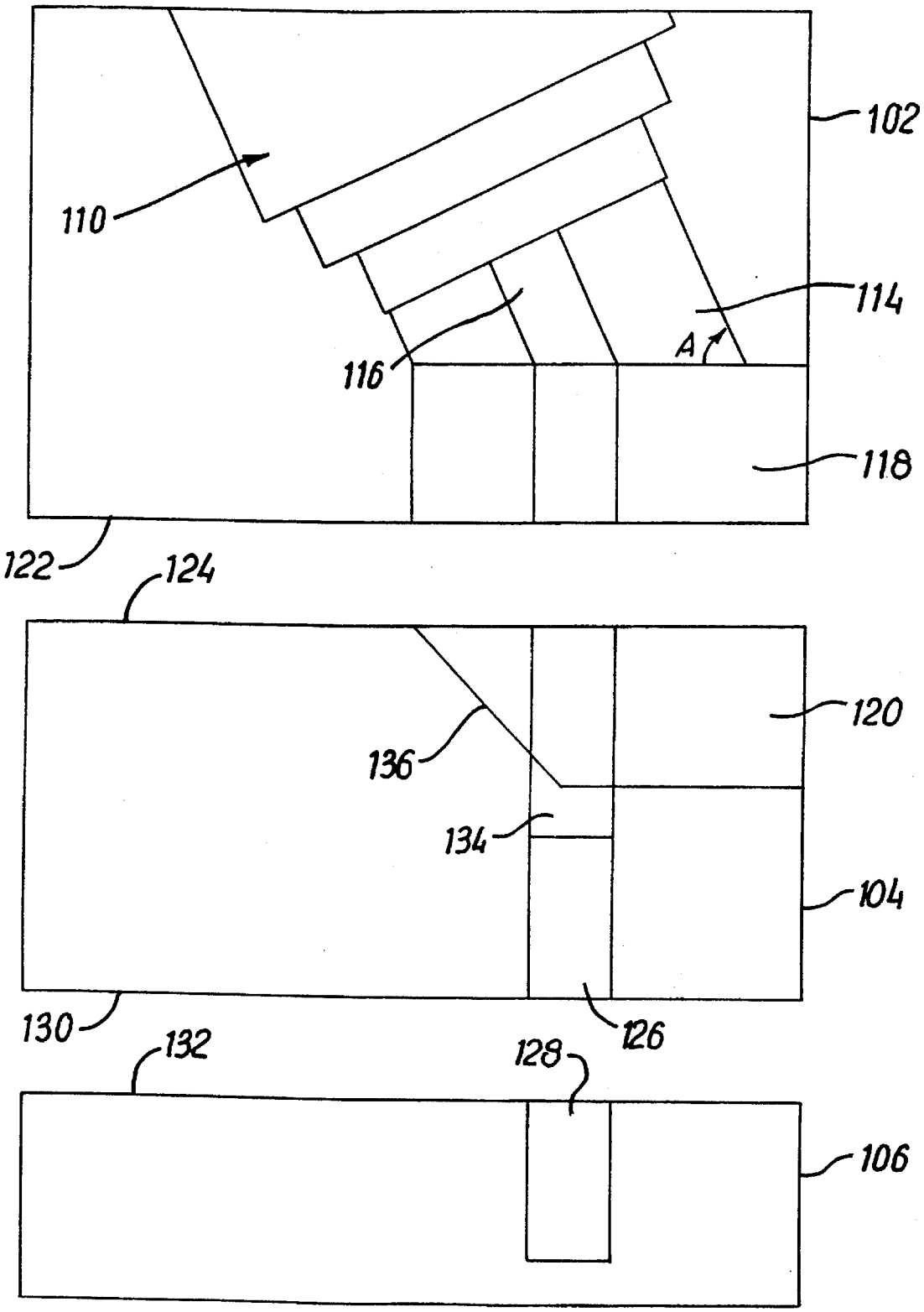
Figure 9:
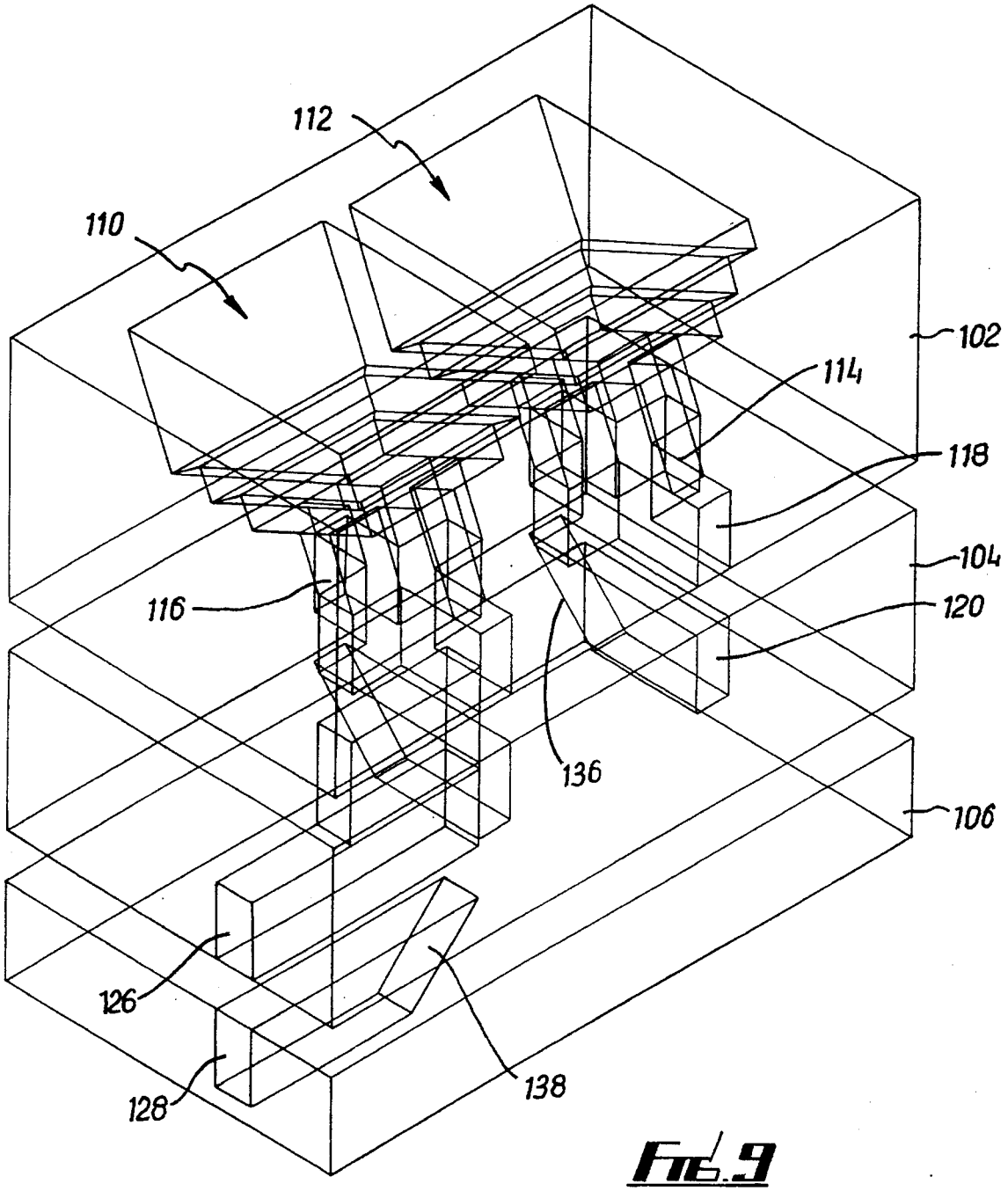
Figure 10:
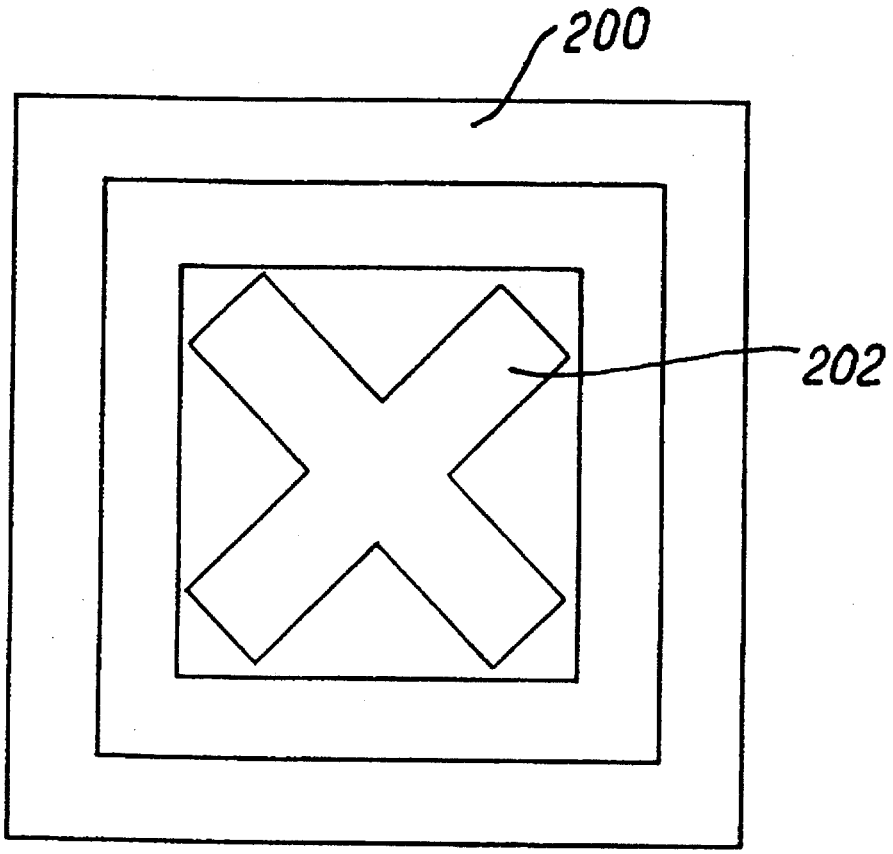

FIGS. 3*a* and 3*b* are detailed sectional views of planar members of the antenna before and after welding together;

FIG. 4 shows the layout of a waveguide array of the antenna;

FIG. 5 shows the corresponding layout of welding ribs and channels;

FIG. 6 is an enlarged plan view of a portion of an antenna embodying the third and fourth aspects of the invention;

FIG. 7 is an exploded sectional view on line II—II of FIG. 6;

FIG. 8 is an exploded sectional view on line III—III of FIG. 6;

FIG. 9 is an exploded isometric view of the antenna portion of FIG. 6; and FIG. 10 is a schematic plan view of an alternative embodiment of a horn antenna element applicable to any of the aspects of the invention.

Figure 1:
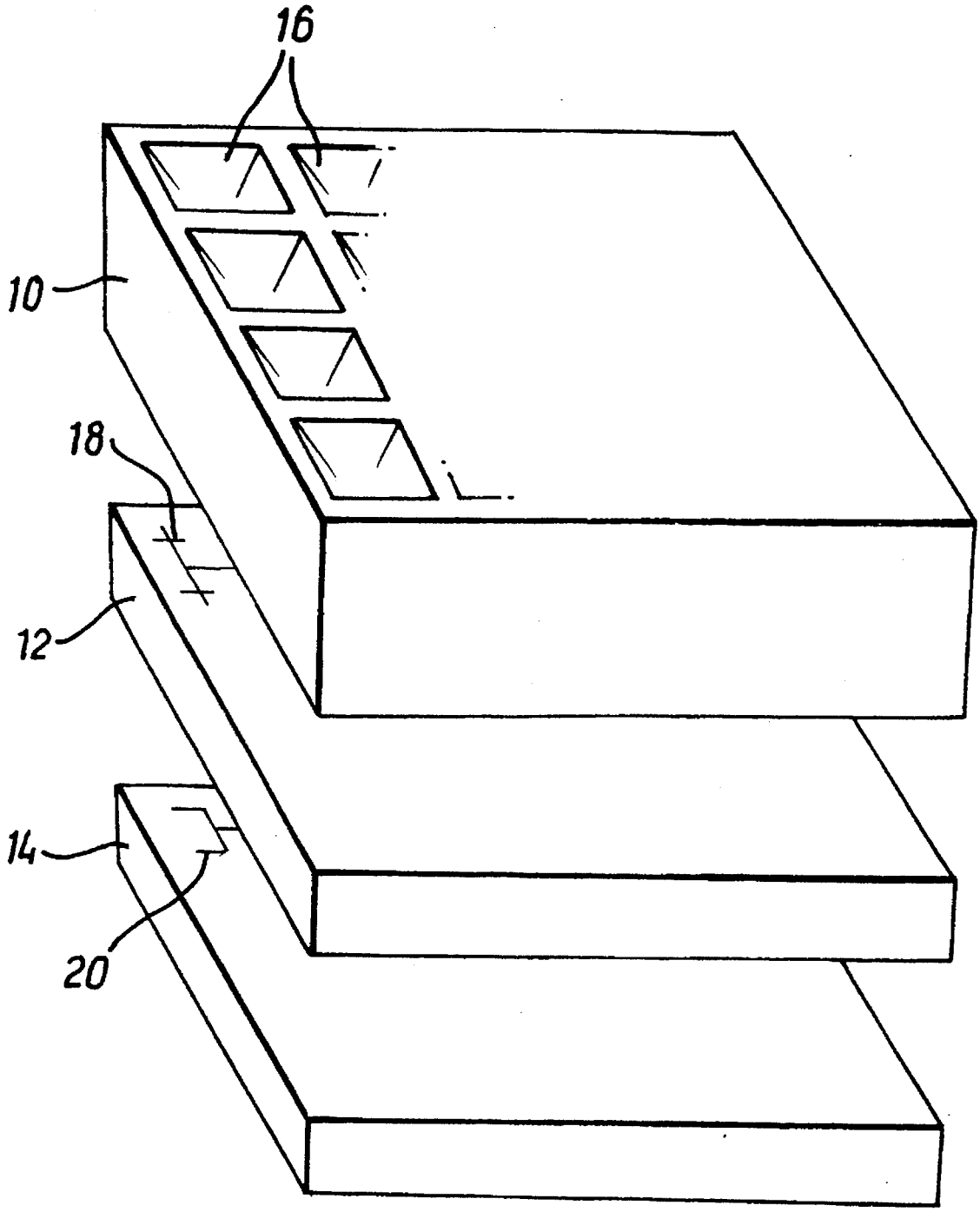
FIG. 1 is a schematic exploded perspective view of a microwave antenna in accordance with the first and second aspects of the invention.
Figure 2:
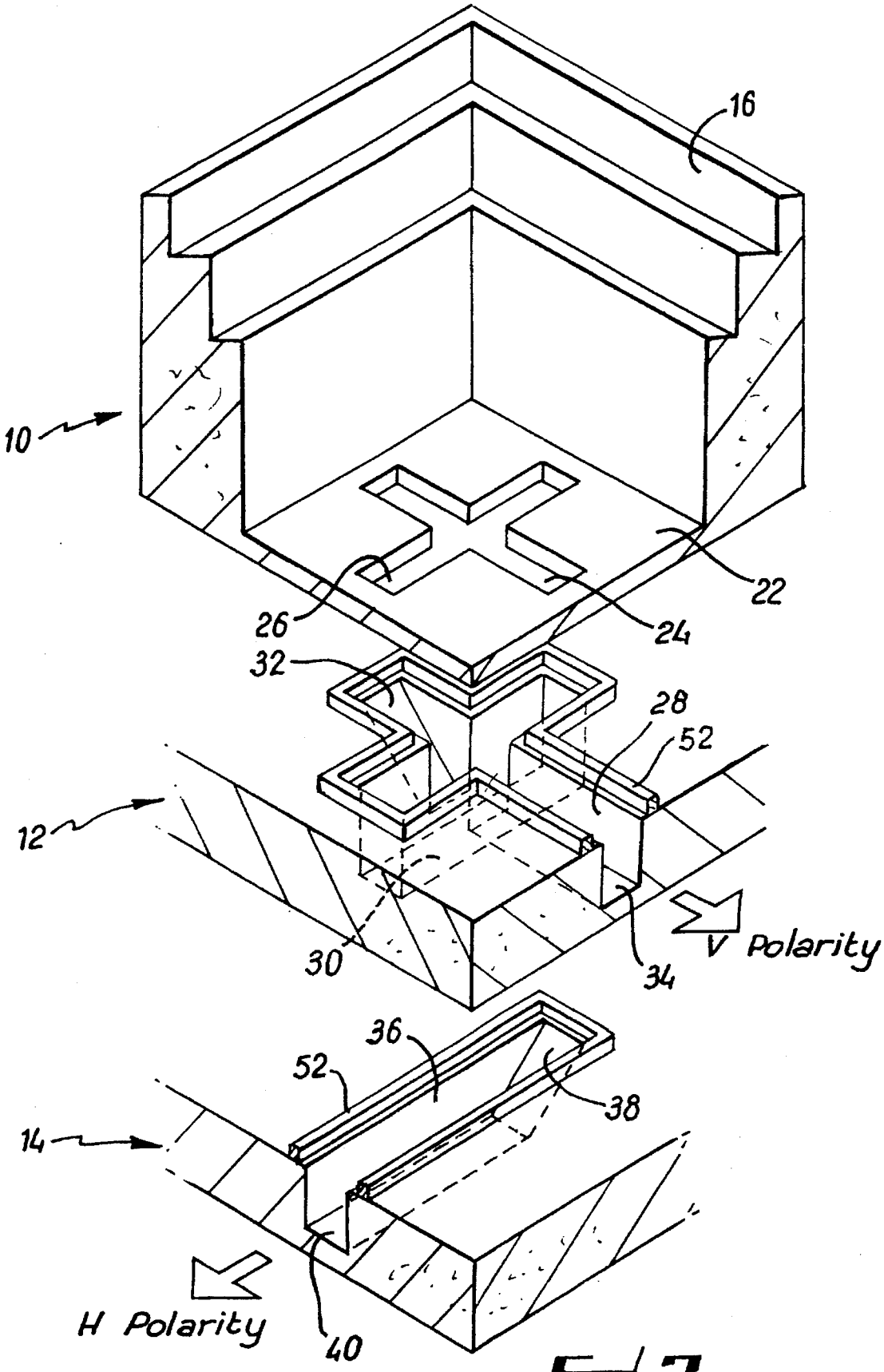
FIG. 2 is an exploded perspective view, partly sectioned, of a part of the antenna of FIG. 1.

FIGS. 1 and 2 show an antenna comprising three planar members 10, 12, 14 each of which can suitably be formed by moulding from expanded polystyrene 5192. After moulding, the three members 10, 12, 14 are secured together and the surfaces left exposed are metallised.

The planar members are secured together by a rib welding technique. To this end, the under surfaces of the members 10 and 12 are formed with ribs 50, and the upper surfaces of the members 12 and 14 are formed with co-operating ribs (not seen in FIG. 2). The ribs extend completely around each opening in the relevant surfaces, and are positioned such that opposing ribs may be abutted, for securement by rib welding as more fully described below.

Once the assembly of the elements 10, 12, 14 has been secured together, the surfaces are metallised, preferably by immersion of the assembly in a bath for electroless copper deposition. Preferably, copper is plated by electroless deposition to a thickness of 4 microns. Other plating methods and materials may be used, for example aluminium and silver.

FIG. 3 shows part of an antenna produced in this way, the metallisation being indicated at 60. It will be noted that the channels such as 62, 64 forming the waveguides are closed by the overlying planar member without the use of metal shims.

FIG. 2 shows an antenna with stepped horns. The invention is equally applicable to antennas with straigth-walled horns, and to antennas in which the horns have septum walls for separation of circularly polarised signals.

In accordance with the invention, the planar members are secured together by a rib welding technique. To this end, the under surfaces of the members 10 and 12 are formed with ribs 50, and the upper surfaces of the members 12 and 14 are formed with ribs 52. The ribs 50 and 52 extend completely around each opening in the relevant surfaces, and are positioned such that opposing ribs 50, 52 may be abutted.

One rib in each opposing pair, in this embodiment the downwardly extending ribs 50, is provided on either side with a channel or flash trap 54. Thus, as seen in FIG. 3, when heat is applied and the surfaces pressed together, the ribs 50, 52 weld together and the flash 56 produced by this operation is accommodated in the channels 54. This allows planar members such as 10, 12 and 14 to be securely adhered together with their faces in accurate planar contact.

Suitable apparatus for rib welding is known per se. It is preferred to use hot plate rib welding which may be carried out with known equipment such as RT 600 VT hot plate welding machine.

FIG. 4 shows a typical array of waveguides 20, and FIG. 5 the corresponding ribs 50 and channels 54, the circles in these Figures indicating registration between the two.

It has been found that antennas produced in this manner give a performance not noticeably different from a similar layout made entirely from metal.

Referring now to FIGS. 6 to 9 of the drawings, there is shown a portion of a planar microwave antenna including two horn elements 110 and 112. It will be understood that in practice the antenna would include a much larger two-dimensional array of such elements. The present example is of a dual-linear array, formed from three layers 102, 104 and 106 which, when assembled, define first and second waveguide networks oriented (in this case) at 90° to one another and communicating respectively with first and second slots 114 and 116 formed at the inner ends of the horn elements 110 and 112.

In the illustrated example the slots intersect to define a cross, however, the slots need not intersect at all.

The first slot 114 of each horn element communicates with the first waveguide network, which comprises an array of channels formed at the interface between the first and second layers 102 and 104 of the antenna by complementary sets of grooves 118 and 120 formed in the bottom surface 122 of the first layer 102 and the top surface 124 of the second layer respectively. The second waveguide network is similarly formed at the interface between the second and third layers by complementary grooves 126 and 128 formed in the bottom surface 130 of the second layer 104 and the top surface 132 of the third layer 104 respectively. The channel defined by the grooves 126 and 128 communicates with the slot 116 via a complementary through-slot 134 formed in the second layer 104.

The inner ends 136 and 138 of the grooves 120 and 128 (facing the slots 114 and 116) are angled at 45° as can be seen in the drawings.

The pairs of grooves 118,120 and 126,128 defining the channels of the first and second waveguide networks are of substantially equal depth, such that the union of the respective surfaces 122, 124 and 130, 132 is substantially at the vertical mid-point of the walls of the channels of the waveguide networks. This significantly reduces the leakage of microwave energy from the channels at the interfaces between the layers 102, 104 and 106, so eliminating or reducing the need for additional manufacturing steps to seal the channels.

The horn elements 110 and 112 themselves are oriented with their central axes disposed at an angle A to the plane of the antenna. This angle can be in elevation, azimuth, or both. By making the angle A equal to the minimum elevation of a given signal source within a defined area, the required vertical angle which the antenna is required to make with the supporting wall can be reduced by the angle A. The most northerly locations (in the Northern hemisphere) within the defined area would thus require zero vertical angle between the antenna and the wall for correct elevation, whilst the most southerly locations would have the required vertical angle significantly reduced. Alternatively, antennas could be manufactured with a range of horn angles in elevation and/or azimuth, and the most appropriate antenna selected for each location within the area.

Apart from their orientation relative to the plane of the antenna, the horn elements can be of any suitable type, a stepped configuration being illustrated in the drawings.

Finally, FIG. 10 shows a single horn antenna element 200, which would be one of an array of identical elements, wherein the intersecting slots 202 at the bottom of the horn 202 are disposed diagonally to the sides of the horn rather than parallel thereto. Again, the slots need not intersect. This variation is applicable to all of the preceding embodiments of the invention.

Modifications and improvements may be incorporated without departing from the scope of the invention.

I claim:

1. An antenna comprising:

a first planar member formed from a plastics material, the first planar member having an upper planar face, a plurality of horns extending from the upper planar face interiorly of the first planar member, a lower planar face, and projecting ribs on said lower planar face;

a second planar member formed from a plastics material, the second planar member having an upper planar face provided with projecting ribs corresponding to those on the lower planar face of the first planar member, said upper planar face of the second planar member also being formed with a system of open-topped channels;

said first and second planar members being in face-to-face relationship with said ribs in contact;

a rib weld on said first and second planar members fixing said first and second planar members together to form a unitary assembly, whereby said open-topped channels are closed by the first planar member to form waveguide channels communicating with said horns; and at least those exposed faces of the assembly defining the horns and the waveguide channels being metallised.

2. The antenna of claim 1, wherein the first planar member is formed to define channels which, when the members are secured together, cooperate with said open-topped channels to define said waveguide system.

3. The antenna of claim 1, wherein one of the lower face of the first planar member and the upper face of the second planar member is formed to provide channel means adjacent each rib.

4. The antenna of claim 3, wherein the channel means comprises identical channels on either side of the rib.

5. The antenna of claim 1 and including projecting ribs on a lower planar face of said second planar member; a third planar member formed from a plastics material, said third planar member having an upper planar face provided with projecting ribs corresponding to those on the lower planar face of the second planar member, said upper planar face of the third planar member also being formed with a system of open-topped channels;

said second and third planar members being positioned in face-to-face relationship with said ribs in contact;

and wherein said third planar member is provided with a rib weld for securing the third planar member to the combination of the first and second planar members to form a unitary assembly, whereby the open-topped channels in the third planar member are closed by the second planar member to form further waveguide channels.

6. The antenna as claimed in claim 1 wherein a metallised layer of copper plated to a thickness of 4 microns is provided on said exposed faces.

* * * * *